US011211039B2

(12) United States Patent
Ryynänen et al.

(10) Patent No.: US 11,211,039 B2
(45) Date of Patent: Dec. 28, 2021

(54) MUSICAL INSTRUMENT TUNING

(71) Applicant: Yousician Oy, Helsinki (FI)

(72) Inventors: Matti Ryynänen, Helsinki (FI); Anssi Klapuri, Helsinki (FI)

(73) Assignee: Yousician Oy, Helsinki (FI)

( * ) Notice: Subject to any disclaimer, the term of this patent is extended or adjusted under 35 U.S.C. 154(b) by 203 days.

(21) Appl. No.: 16/554,917

(22) Filed: Aug. 29, 2019

(65) Prior Publication Data

US 2021/0065664 A1 Mar. 4, 2021

(51) Int. Cl.
*G10G 7/02* (2006.01)

(52) U.S. Cl.
CPC ..... *G10G 7/02* (2013.01)

(58) Field of Classification Search
CPC ..... G10G 7/02
See application file for complete search history.

(56) References Cited

U.S. PATENT DOCUMENTS

| | | | | |
|---|---|---|---|---|
| 3,124,884 | A * | 3/1964 | Capecelatro et al. | G09B 23/12 434/126 |
| 4,217,702 | A * | 8/1980 | Bennett | G09B 23/02 434/188 |
| 4,429,609 | A | 2/1984 | Warrender | |
| 5,877,443 | A | 3/1999 | Arends et al. | |
| 2004/0025672 | A1 | 2/2004 | Carpenter | |
| 2010/0212475 | A1 | 8/2010 | Toulson | |
| 2018/0225083 | A1 * | 8/2018 | Barkley | G06F 3/04883 |
| 2018/0357920 | A1 | 12/2018 | Terashima et al. | |

FOREIGN PATENT DOCUMENTS

| | | | |
|---|---|---|---|
| EP | 1742199 | A1 | 1/2007 |
| JP | 2004355015 | A | 12/2004 |
| WO | 2013022918 | A1 | 2/2013 |

OTHER PUBLICATIONS

Petersontuners, "How Does a Strobe Tuner Work?" published Oct. 27, 2015, accessed Aug. 28, 2019, retrieved from www.youtube.com/watch?v=U8KHeyT6xB0, 5 pages.

Pmtvuk, "TC Electronic Polytune Clip Tuner Demo" published Jul. 6, 2015, accessed Aug. 28, 2019, retrieved from www.youtube.com/watch?v=CiW3RF2Fbzs, 3 pages.

"Acoustic guitar tuning by the Realtime Analyzer (Instrument tuning 1)" YMEC Software, Nov. 2002, 10 pages.

European Patent Office, Extended European Search Report, Application No. 20182134.5, dated Nov. 16, 2020, 10 pages.

* cited by examiner

*Primary Examiner* — Jianchun Qin
(74) *Attorney, Agent, or Firm* — Ziegler IP Law Group, LLC

(57) ABSTRACT

A digital tuner that determines a tuning target period; receives an audio signal from an instrument to be tuned; obtains a plurality of different segments of the audio signal starting at times that correspond to integer multiples of the target period; produces waveform samples from the segments; and displays of a succession of waveform segments at same display position using said segments so that the shape of the waveform appears to move on the display at a speed and direction directly dependent on a difference of a wave period of the audio signal to be tuned and the tuning target period.

14 Claims, 4 Drawing Sheets

MUSICAL INSTRUMENT TUNING

TECHNICAL FIELD

The aspects of the disclosed embodiments generally relate to musical instrument tuning.

BACKGROUND ART

This section illustrates useful background information without admission of any technique described herein representative of the state of the art.

Many musical instruments need to be tuned in order to produce correct pitches for the notes played. For example, the strings of a guitar tend to go out of tune over time and need to be regularly retuned. The same applies to many other instruments too, e.g., in string, brass, and woodwind instrument families. FIG. 1 shows an illustration of a musical sound over a plurality wave periods.

In past, tuning was performed by comparing the musical sound against a reference tone produced by a tuning fork for example. However, for convenience and accuracy, nowadays tuning is almost always performed using digital tuners. Such tuners indicate whether the pitch is too low or too high so that a user can tune her instrument accordingly.

A typical tuner has a needle or other kind of pointer that indicates whether the pitch of the sound is too low or too high, and how much. The user then tunes the instrument accordingly until the tuner indicates that the difference to a target pitch is sufficiently small.

Stroboscopic or strobe tuners are one special kind of tuners that is often considered most accurate tuner type. A strobe tuner consist of a translucent mechanical disc with rings, a motor for spinning the disc, and a light source (an LED array) to flash lights behind the disc. Each ring has white and black blocks, and the block count per ring doubles for every ring when moving outwards from the disc center (the first ring has 4 blocks, the second one 8, the third one 16, and so forth). The motor spins the disc with a fixed frequency that matches the target tuning pitch. The tuner flashes lights behind the disc in synchronicity with the musical instrument frequency. When instrument frequency matches the target frequency, the lights and disc spinning are performed in sync and the disc appears to stop moving. On the contrary, when the instrument frequency does not match the target frequency, the blocks on the rings appear to move and the resulting image becomes blurred. While tuning, the user adjusts the instrument pitch until the resulting image appears to be stopped.

Some digital tuners mimic the above-described analog/mechanical strobe tuners. With modern digital technology, it is possible to device a digital "strobe tuner" that merely provides a way of visually mimicking the strobe tuner whereas actually the pitch of the sound has been measured using any of the existing pitch estimation methods and the visualization is adapted to indicated a digitally determined difference.

SUMMARY

According to a first example aspect there is provided a digital tuning method comprising:

determining a tuning target period;

receiving an audio signal from an instrument to be tuned;

obtaining a plurality of different segments of the audio signal starting at times that correspond to different integer multiples of the target period;

producing waveform samples from the segments; and causing displaying of a succession of waveform segments at same display position so that the shape of the waveform appears to move on the display at a speed and direction directly dependent on a difference of a wave period of the audio signal to be tuned and the tuning target period.

The instrument may be a musical instrument or a voice of a singer.

The displaying of the succession of waveform segments may employ a representation other than the time-domain acoustic waveform of the sound.

The representation may have time resolution higher than a rate at which the target periods are received. There may be several successive time-points in the representation within each individual target period.

The representation may comprise filtered versions of the acoustic waveform. The filtered versions may be produced using lowpass filtering of the acoustic waveform. The filtered versions may be produced using highpass filtering of the acoustic waveform. The filtered versions may be produced using bandpass filtering of the acoustic waveform.

The representation may comprise a power envelope of the acoustic waveform. The power envelope may be obtained by squaring each sample value of the sound waveform and optionally applying filtering such as low-pass filtering on the squared signal.

The representation may comprise a time-frequency spectrogram of the input signal. The spectrogram may have time resolution that high that the distance between successive spectra ("frames") in the spectrogram is shorter than the target period T. The spectrogram may be based on several different frequency magnitudes at each of a plurality of time points to describe the spectrum of the sound at those points.

According to a second example aspect there is provided a digital tuner comprising:

a tuning period selector configured to determine a tuning target period;

an input for receiving an audio signal from the instrument to be tuned;

at least one processor configured to cause:

obtaining a plurality of different segments of the audio signal starting at times that correspond to different integer multiples of the target period;

producing waveform samples from the segments; and causing displaying of a succession of waveform segments at same display position using so that the shape of the waveform appears to move on the display at a speed and direction directly dependent on a difference of a wave period of the audio signal to be tuned and the tuning target period.

The waveform segments may be defined to start at times $t_s = M \cdot T$, where M=0, 1, 2, . . . is a whole number i.e. an integer greater or equal to zero and T is the target tuning period.

The length of the displayed waveform segments may have a length L. L may be equal to the target tuning period T. L may be greater than T.

The term "target pitch" may refer to a desired pitch (in Hertz, for example) of the musical sound being tuned. The term "target period" may refer to a desired waveform period (in seconds) of the musical sound of an instrument being tuned. The target period and the target pitch encode same information so that one can be obtained from the other by calculating its inverse. For example, a target pitch of 400 Hz corresponds to a target period of 1/400 Hz=2.5 ms.

The tuning period selector may comprise a user interface configured to receive the tuning target pitch from a user.

Alternatively or additionally, the tuning period selector may comprise a tuning period selection circuitry configured to perform an automatic selection of the target pitch.

The performing of the automatic selection of the target pitch may comprise determining current pitch of the received audio signal to be used. The determining of the current pitch may be based on a time-to-frequency domain transform such as a Fast-Fourier transform and/or a discrete cosine transform.

The performing of the automatic selection of the target pitch may further comprise choosing a musical note nearest to the determined current pitch. The musical note may be chosen from a pre-defined musical scale. The pre-defined musical scale may be constant. Alternatively, the pre-defined musical scale may be user-selectable or modifiable. The pre-defined musical scale may be an equally tempered musical scale, such as a 12-tone equally tempered musical scale. Alternatively, the musical note may be chosen from among a finite set of musical note candidates. The set of note candidates may be defined based on the standard tuning of the strings of a certain instrument (for example six notes that represent the standard tuning of guitar strings). The set of note candidates may be chosen by the user.

The performing of the automatic selection of the target pitch may further comprise monitoring dynamic changing of the current pitch and dynamically changing the target pitch if another musical note has become nearer to the current pitch. The dynamic changing of the target pitch may be subjected to a hysteresis criterion so as to avoid rapid alternating between different target frequencies. The hysteresis criterion may be that a current pitch has been nearer to the another musical note for a period of at least a pre-defined number of milliseconds. The hysteresis criterion may be that a current pitch has exceeded the boundary between two neighboring target pitch candidates by a pre-defined sufficiently large margin.

The input for receiving the audio signal to be tuned may comprise a microphone signal input. Alternatively or additionally, the input for receiving the audio signal to be tuned may comprise an instrument sound vibrator pickup input, such as an input for a pickup signal of an electric string instrument.

The at least one processor may in part form the tuning period selector.

The waveform samples representing the audio signal to be tuned may be subjected to processing or transformation before displaying the waveform samples to the user. For example, the waveform samples may be subjected to low-pass, highpass, or bandpass filtering, or the waveform sample values may be squared or clamped above or below, or any combination of those.

The waveform samples may be formed by combining groups of segments. The combining may be performed by averaging. The combining may be performed by weighed averaging. The weighed averaging may weigh most recent segments more than older segments.

The waveform samples may be representations other than a time-domain acoustic waveform of the sound. For example time-frequency spectrogram of the input signal can be used, provided that its time resolution is high enough so that the distance between successive spectra ("frames") in the spectrogram is shorter than the target period.

The displayed waveform segments start at times is that correspond to integer multiples of the target period length T: $t_s=M\cdot T$, where M=0, 1, 2, . . . Waveform segments corresponding to certain values of i may not be displayed at all, for example in the case that the target tuning period is much shorter than the time period between successive screen refresh times.

The displayed waveform segments may have a duration corresponding to x times the tuning target period, where x may be larger or smaller than 1. In an embodiment, x=1 or x=2, meaning that the length of the displayed waveform segment corresponds to one or two times the target tuning period length.

The successive waveform segments may be presented as curves that show the waveform values within each segment as a function of time, so that time distance to the segment start determines the coordinate along one dimension and waveform value at that point in time determines the coordinate along the other dimension. The diagrams may be horizontally aligned. Alternatively, the diagrams may be vertically aligned. The diagrams may be presented with time increasing towards right-hand side or down. Alternatively, the diagrams may be presented with time increasing towards left-hand side or up.

Alternatively, the successive waveform segments may be presented as a one line of pixels, where time distance to the segment start determines the coordinate along the line, and the waveform value determines the color of the pixel. The line may be horizontally aligned. Alternatively, the line may be vertically aligned. The line may be drawn with time increasing towards right-hand side or down. Alternatively, the line may be drawn with time increasing towards left-hand side or up.

The successive waveform segments may be presented with a length on the display proportional to the tuning target period. By presenting the successive waveform segments with a length on display proportional to the tuning target period, the successive waveform segments may be displayed with similar display length regardless of the tuning target pitch and tuning target period. The speed with which the successive waveform segments appear to move may then be proportional to required proportional tuning change, which may be more intuitive than speed proportional to absolute difference, e.g., when a guitar or violin is being tuned with a plurality of strings with different target tuning frequencies.

The number of samples displayed from the segments may correspond to the length of the target period multiplied by X, where X is a real number larger than zero. X may be selected from a group consisting of 1.0; 2.5; and 0.5.

The magnitude of the successive waveform samples may be automatically scaled. The automatic scaling may be directed to each displayed waveform segment as a whole. The automatic scaling of the magnitude may amplify each of the successive waveform samples to meet or exceed a given minimum magnitude. The automatic scaling of the magnitude may attenuate each of the successive waveform samples to meet or go below a given maximum magnitude. The automatic scaling may facilitate using naturally attenuating last sound output of an instrument for tuning while turning a tuning member of the instrument, for example.

The automatic scaling may be dynamically varying. The automatic scaling may be performed using an envelope follower. An envelope follower parameter E is first initialized to zero. Then the value of E is updated for each sub-part (for example, for each sample of the acoustic waveform or for each group of two or more of such samples) as follows: an absolute value A is determined for each sub-part. If A>E, then the value of A is stored in E, otherwise E is given a new value of r·E, wherein r is a real-valued constant smaller than 1 and typically close to 1. An automatic scaling factor G is then set to be G=c/E, where c is a constant value that is proportional to the size of the display area in a direction in which the amplitude of the displayed waveforms is presented.

The succession of the waveform segments may consist of one or more of the segments. The succession of the waveform segments may be formed using said segments as such when respective target tuning periods are sufficiently synchronized with display refreshing periods. For segments with respective target tuning periods not sufficiently synchronized with display refreshing periods, waveform segments may be interpolated or extrapolated from other waveform segments. Interpolated waveform segments may be used as among the succession of the waveform segments.

The at least one processor may be configured to cause said displaying of the succession of segments such that the succession of the waveform segments is maintained visible while displaying another succession of the waveform segments. Older successions of the waveform segments may be displayed with a first appearance and one or more most recent successions of the waveform segments may be displayed with a second appearance. The second appearance may be different than the first appearance. The second appearance may differ from the first appearance by color. The second appearance may differ from the first appearance by line thickness.

The at least one processor may be configured to cease causing said displaying of the succession of segments if the waveform has a period differing from the tuning target period by an amount meeting or exceeding a difference threshold. The difference threshold may be proportional to the tuning target period. Alternatively, the difference threshold may be an absolute maximum for the difference between the waveform period and the tuning target period.

The at least one processor may be configured to adjust the tuning target period depending on a difference between the wave period of the audio signal to be tuned and the tuning target period. The at least one processor may be configured to indicate the adjusting of the tuning target period with a perceivable appearance change of the waveform samples with greater frequency difference between the frequency of the audio signal to be tuned and the tuning target pitch.

The perceivable appearance change may comprise displaying the waveform samples with a reduced magnitude.

The at least one processor may be configured to set the tuning target period back to the original value of the tuning target period when the difference between the wave period of the audio signal to be tuned and the tuning target period meets a given closeness criterion, such a percentage selected from a group consisting of: 0.1%; 0.2%; 0.5%; 1%; 2%; 5%; 10%; and 20%.

The at least one processor may be configured to determine movement speed of the waveform samples by computing the movement distance of successive waveform segments divided by the time difference between the respective waveform segment start times. The at least one processor may be further configured to provide a quantifying indication of the movement speed to a user. The quantifying indication may comprise showing a numeric value of the movement speed. The quantifying indication may comprise showing a meter or gauge with a movement speed indication.

According to a third example aspect there is provided a digital tuning method comprising:

determining a tuning target period;

receiving an audio signal from an instrument to be tuned;

sampling the audio signal; and producing a combination signal for employing wave interference by adding an inversed first waveform segment corresponding to an earlier portion of the received audio signal to a second waveform segment representing a subsequent portion of the audio signal;

wherein the first segment and the second segment correspond to portions of the audio signal starting at different integer multiples M of tuning target period T, wherein M is an integer greater than or equal to zero;

the method further comprising outputting the combination signal in order to indicate tuning of the audio signal.

According to a fourth example aspect there is provided a digital tuner comprising:

a tuning period selector configured to determine a tuning target period;

an input for receiving an audio signal from the instrument to be tuned;

at least one processor configured to repeatedly cause:

sampling the audio signal; and producing a combination signal for employing wave interference by adding an inversed first waveform segment representing an earlier portion of the received audio signal to a second waveform segment representing a subsequent portion of the audio signal;

wherein the first segment and the second segment are based on portions of the audio signal starting at different integer multiples M of tuning target period T, wherein M is an integer greater than or equal to zero;

outputting the combination signal in order to indicate tuning of the audio signal.

Successive segments of the combination signal may be concatenated to form a continuous audio signal. The concatenation may be carried out by setting the length of the waveform segments L to be larger than the target period T (for example L=2T) and cross-fading between successive segments. The cross-fading may employ a window function that tapers off the head and tail portions of each segment. The window function may be a Hamming window function. The window function may be a Hanning window function.

The outputting of the combination signal may comprise acoustically producing the combination signal.

The outputting of the combination signal may comprise visually producing the combination signal.

According to an fifth example aspect there is provided a computer program comprising computer executable program code which when executed by at least one processor causes an apparatus at least to perform the method of the first or third example aspect.

According to a sixth example aspect there is provided a computer program product comprising a non-transitory computer readable medium having the computer program of the fifth example aspect stored thereon.

Different non-binding example aspects and embodiments of the present invention have been illustrated in the foregoing. The embodiments in the foregoing are used merely to explain selected aspects or steps that may be utilized in implementations of the present invention. Some embodiments may be presented only with reference to certain example aspects. It should be appreciated that corresponding embodiments may apply to other example aspects as well.

BRIEF DESCRIPTION OF THE DRAWINGS

Some example embodiments will be described with reference to the accompanying drawings, in which.

DETAILED DESCRIPTION

In the following description, like reference signs denote like elements or steps.

Figure 1:
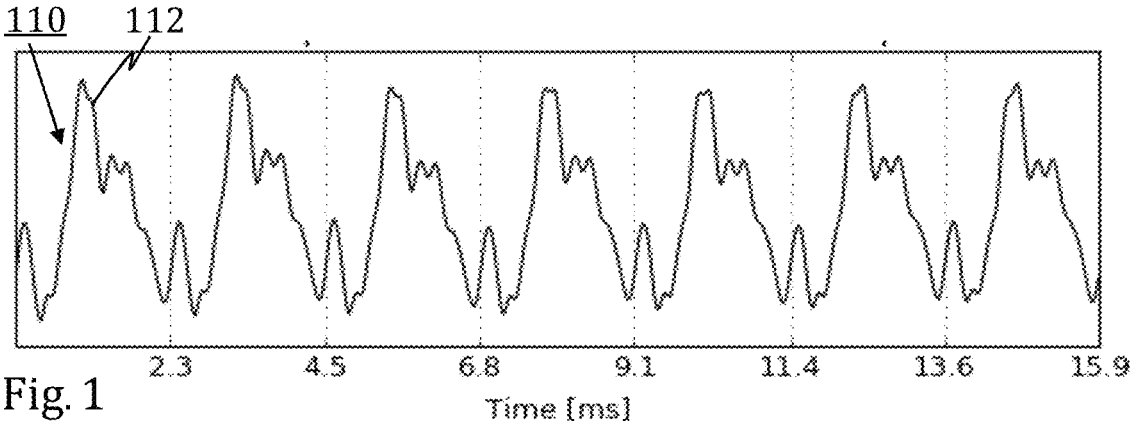
FIG. 1 shows a time domain illustration of a musical sound over a plurality wave periods.
Figure 2:
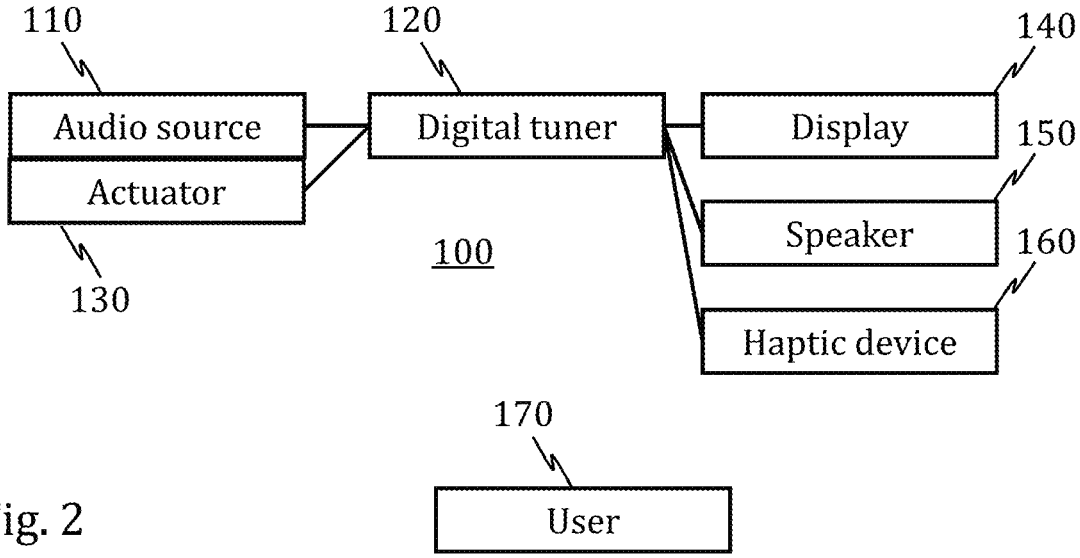
FIG. 2 shows a schematic drawing of a system according to an embodiment.

FIG. 1 shows a schematic drawing of a system 100 according to an embodiment. The system 100 comprises an audio source 110 to be tuned, such as a string of a guitar or violin, or a singer. The system 110 further comprises a digital tuner 120. In some embodiments, the system 100 further comprises an automatic actuator 130 controllable by the digital tuner 120 for automatically tuning the audio source when the audio source is an instrument. In some embodiments, the system 100 further comprises an external display 140, an external speaker 150 or a haptic user interface device 160, for outputting information from the digital tuner 120 to a user 170 also drawn in FIG. 2.

Some of the embodiments disclosed herein are based on that in order to find out whether a musical sound is higher or lower than a given target pitch, it is sufficient to visualize the sound itself to the user in a specific way. That provides the user sufficient information to decide if the sound is in tune or too low or too high, and allows her to tune the musical instrument accurately. In other words, the pitch of the sound does not need to be measured at all, but the user herself replaces a tuning measurement device common in present digital tuners by looking at the visualization and judging from that whether the sound is too low or too high, and by how much.

Let us refer back to FIG. 1. Pitched musical sounds exhibit periodicity in their time-domain waveform 112. FIG. 1 illustrates a guitar sound with a pitch of 440 Hz and period-length of 1/440 Hz=2.27 ms. Vertical grid lines in FIG. 1 indicate multiples of the period length of the sound. As can be seen, the waveform from one period to the next is nearly identical. This is illustrated also in FIG. 3, where individual periods of the waveform 112 are overlaid on top of each other. Although the waveshape does not stay exactly the same, it changes very slowly: gradually morphing from one shape to another. Such pseudoperiodicity is characteristic to the sounds of pitched musical instruments.

Let us now consider a situation where a tuning target pitch $f_{TP}$ (and therefore also a tuning target period length $p_{TP}$) is given in advance. That is the situation when tuning a musical instrument: the correct tuning target pitch value $f_{TP}$ is given and the user 170 tries to adjust the musical instrument in order to produce a pitch that would match the tuning target pitch value $f_{TP}$.

Figure 4:
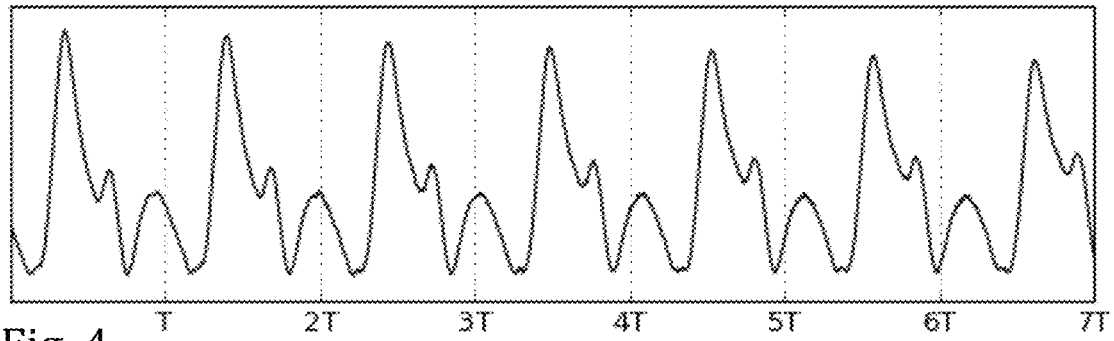
FIG. 4 shows in time domain a musical sound with a too low pitch.

FIG. 4 shows in time domain a musical sound where the sound produced by the instrument has too low pitch ("flat") and therefore the waveform 112 has a period that is longer than the tuning target period $p_{TP}$.

Figure 5:
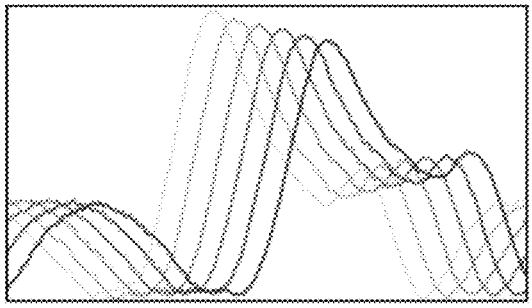
FIG. 5 illustrates in time domain shapes of a plurality of successive periodic waves of FIG. 4 drawn on top of each other for illustrating similarity of successive waveforms.

FIG. 5 illustrates in time domain shapes of a plurality of successive periodic waves of FIG. 4 drawn on top of each other for illustrating similarity of successive waveforms 112. In this case, the waveform shape appears to moves right. In other words, the waveform shape does not remain horizontally stable, but the latest waveform segment is further to the right-hand direction than the earlier segments.

Figure 6:
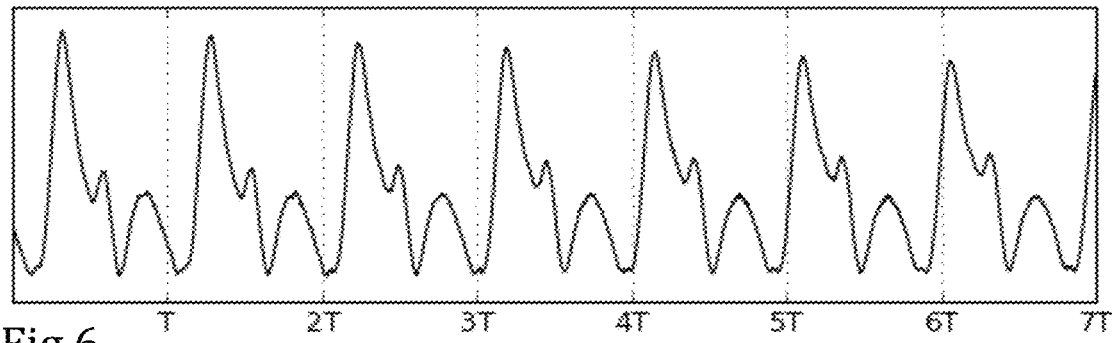
FIG. 6 shows in time domain a musical sound where the sound produced by the instrument has too high pitch.

FIG. 6 shows in time domain a musical sound where the sound produced by the instrument has too high pitch ("sharp") and therefore the waveform 112 has a period that is shorter than the tuning target period $p_{TP}$.

Figure 7:
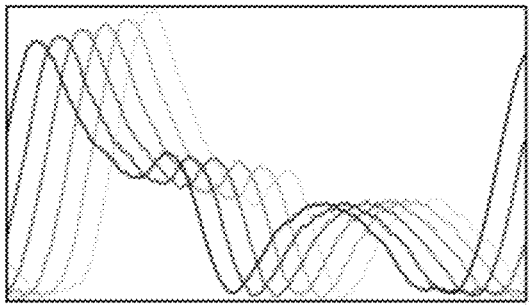
FIG. 7 illustrates in time domain shapes of a plurality of successive periodic waves of FIG. 6 drawn on top of each other.

FIG. 7 illustrates in time domain shapes of a plurality of successive periodic waves of FIG. 6 drawn on top of each other for illustrating similarity of successive waveforms 112. In this case, the waveform shape appears to moves left. In other words, the waveform shape does not remain horizontally stable, but the latest waveform segment is further to the left-hand direction than the earlier segments.

Figure 3:
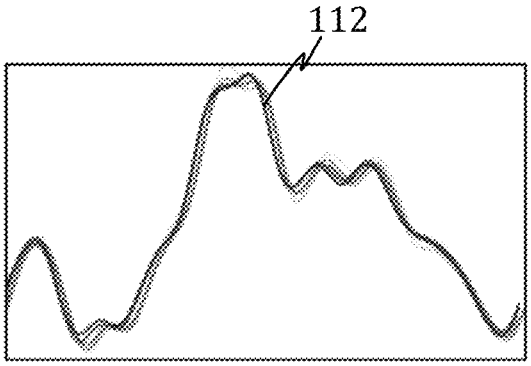
FIG. 3 illustrates in time domain shapes of a plurality of successive periodic waves of FIG. 1 drawn on top of each other for illustrating similarity of successive waveforms.

In some embodiments, there is no need to measure or estimate the pitch of the produced musical sound in order to allow the user to tune the musical instrument. Instead, the musical sound is received and displayed in short segments so that subsequent segment of the musical sound are picked from a temporal position that is a multiple of the target tuning period $p_{TP}$. When the sound is perfectly in tune, the display "stabilizes" horizontally as illustrated by FIG. 3. If the sound is slightly too low ("flat"), the image moves/scrolls towards right (see FIG. 5), which indicates to the user that she should tune the pitch higher. Movement to the opposite direction (see FIG. 7) indicates that the pitch is too high.

In practice, the frame-rate of the display device may not match the pitch of the sound: the interval between screen updates (for example 60 frames per second) is usually different from the rate at which we receive periods of the sound waveform 112 (for example 440 times per second). Various embodiments improve compatibility of the display device with the pitch of the sound for further smoothing the presentation whereas some embodiments simply display with the frame rate of the display. For example, one embodiment always draws the latest received segment of the audio waveform 112 that starts at a multiple of target period T and has been fully received before the screen update.

Figure 8:
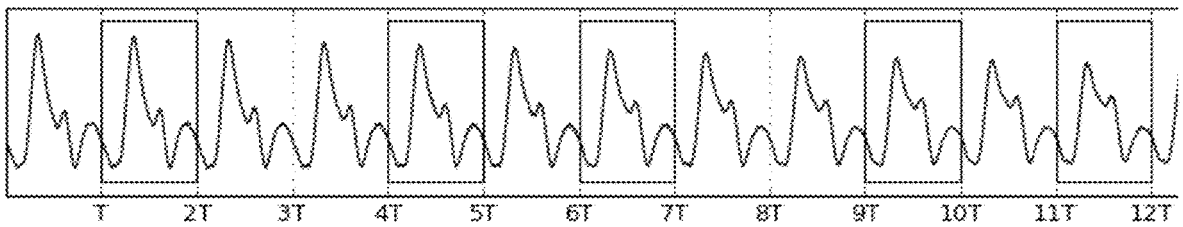
FIG. 8 schematically illustrates screen update matching of an embodiment.

FIG. 8 schematically illustrates screen update matching of an embodiment. In FIG. 8, the screen update interval is 2.5 times longer than the time interval between successive tuning target periods $p_{TP}$. In FIG. 8, rectangles are drawn to indicate latest received complete segment or tuning target period before each screen update. In this case, every second or third wave is displayed. Another embodiment displays all the fully-received periods that have arrived between two screen updates, or a fixed number of latest periods. Yet another embodiment calculates a point-by-point average of all the segments or a fixed number of the segments that have arrived since the previous screen update and displays the average waveshape.

Figure 9:
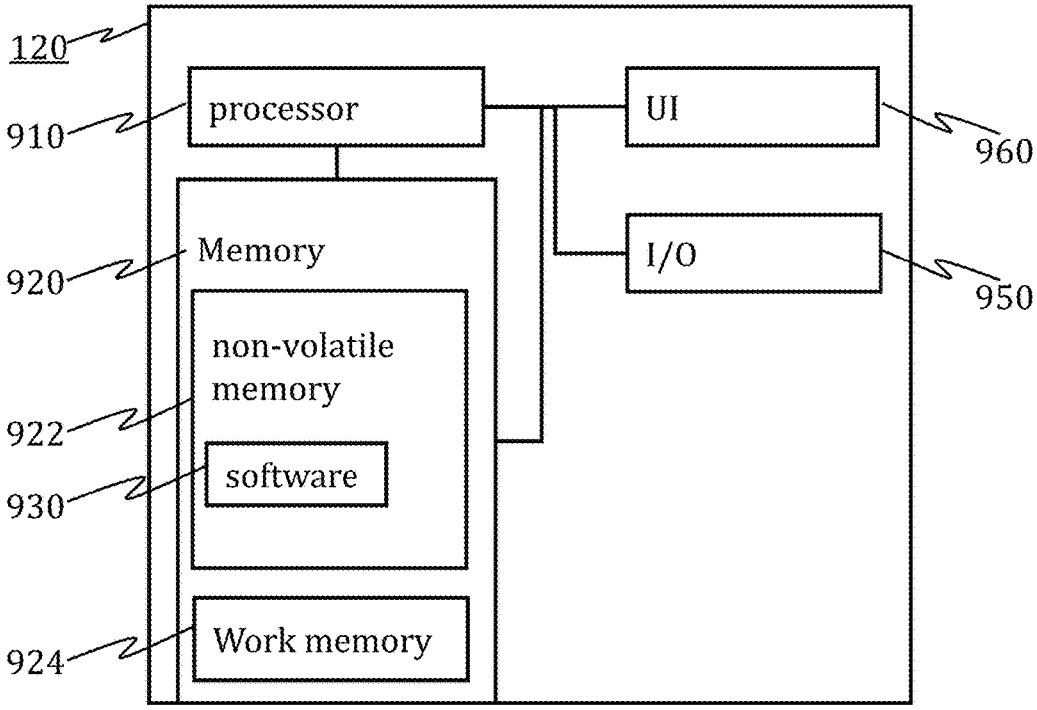
FIG. 9 shows a block diagram of a digital tuner according to an embodiment.

FIG. 9 shows a block diagram of a digital tuner 120 according to an embodiment. The digital tuner 120 comprises a memory 920 including a non-volatile memory 922 configured to store computer program code 930. The digital tuner 120 further comprises a processor 910 for controlling the operation of the digital tuner 120 using the computer program code 930, a work memory 924 for running the computer program code 304 by the processor 301, an input (or input/output) unit 960 for receiving audio signals and optionally communicating to other entities such as the actuator 130. The processor 301 may be a master control unit (MCU). Alternatively, the processor may be a microprocessor, a digital signal processor (DSP), an application specific integrated circuit (ASIC), a field programmable gate array, a microcontroller or a combination of such elements. In some embodiments, the digital tuner is a remote device accessible by radio or through a communication network, such as the Internet. Particularly in that case, the hardware of the digital tuner may be virtualized or similar functions may be provided through cloud computing. The digital tuner 120 further comprises a user interface 960 for displaying and/or presenting acoustic information to the user 170.

Figure 10:
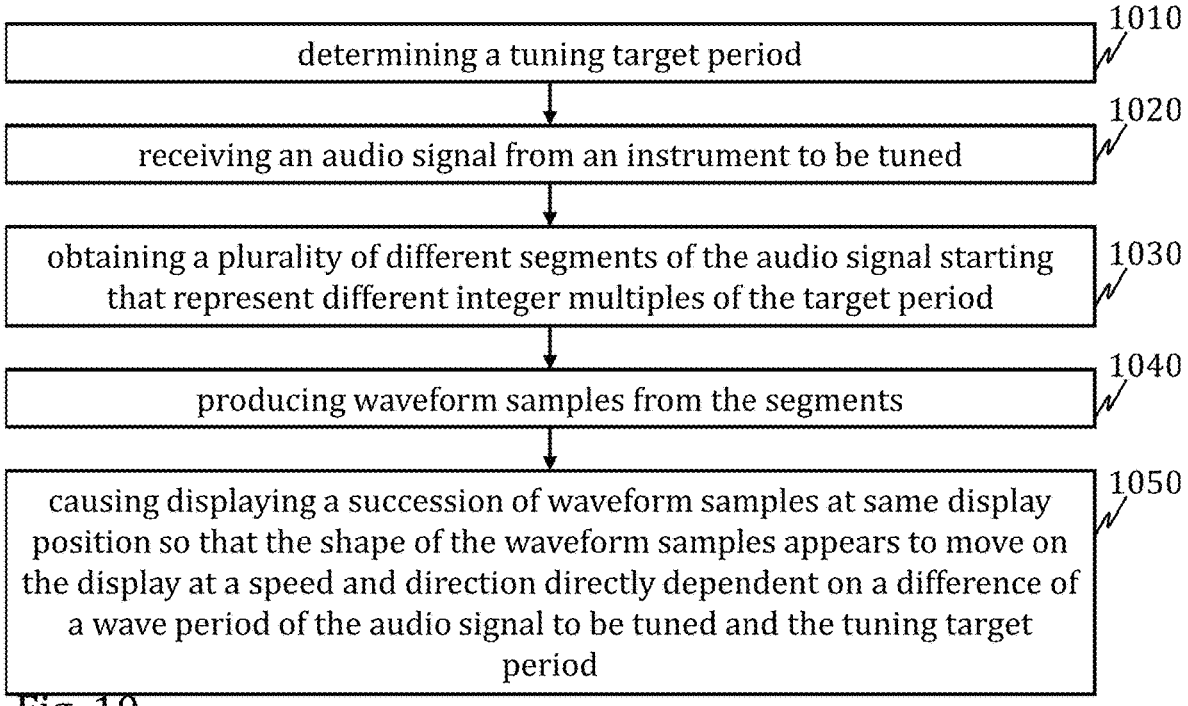
FIG. 10 shows a flow chart illustrating operation of a digital tuner of a first example aspect.

FIG. 10 shows a flow chart illustrating operation of a digital tuner of a first example aspect, comprising:

1010. determining a tuning target period;

1020. receiving an audio signal from an instrument to be tuned;

1030. obtaining a plurality of different segments of the audio signal starting that correspond to different integer multiples of the target period;

1040. producing waveform samples from the segments; and

1050. causing displaying a succession of waveform samples at same display position so that the shape of the waveform samples appears to move on the display at a speed and direction directly dependent on a difference of a wave period of the audio signal to be tuned and the tuning target period.

In an embodiment, the displaying 13 ∧length of the succession of waveform segments employs a representation other than the time-domain acoustic waveform of the sound.

The representation has time resolution higher than a rate at which the target periods are received so that there are several successive time-points in the representation within each individual target period.

In an embodiment, the representation comprises filtered versions of the acoustic waveform 112. For example, filtered versions may be produced using any of lowpass, highpass, and/or bandpass filtering.

In an embodiment, the representation comprise a power envelope of the acoustic waveform 112, which power envelope can be obtained, for example, by squaring each sample value of the sound waveform 112 and optionally applying filtering such as low-pass filtering on the squared signal.

In an embodiment, the representation comprises a time-frequency spectrogram of the input signal. The spectrogram has time resolution that high that the distance between successive spectra ("frames") in the spectrogram is shorter than the target period T. The spectrogram is based on several different frequency magnitudes at each of a plurality of time points to describe the spectrum of the sound at those points. To this end, the spectrogram can be displayed as an image with different colors or shades of gray representing the numerical values at different time-frequency positions or as a three-dimensional chart.

Figure 11:
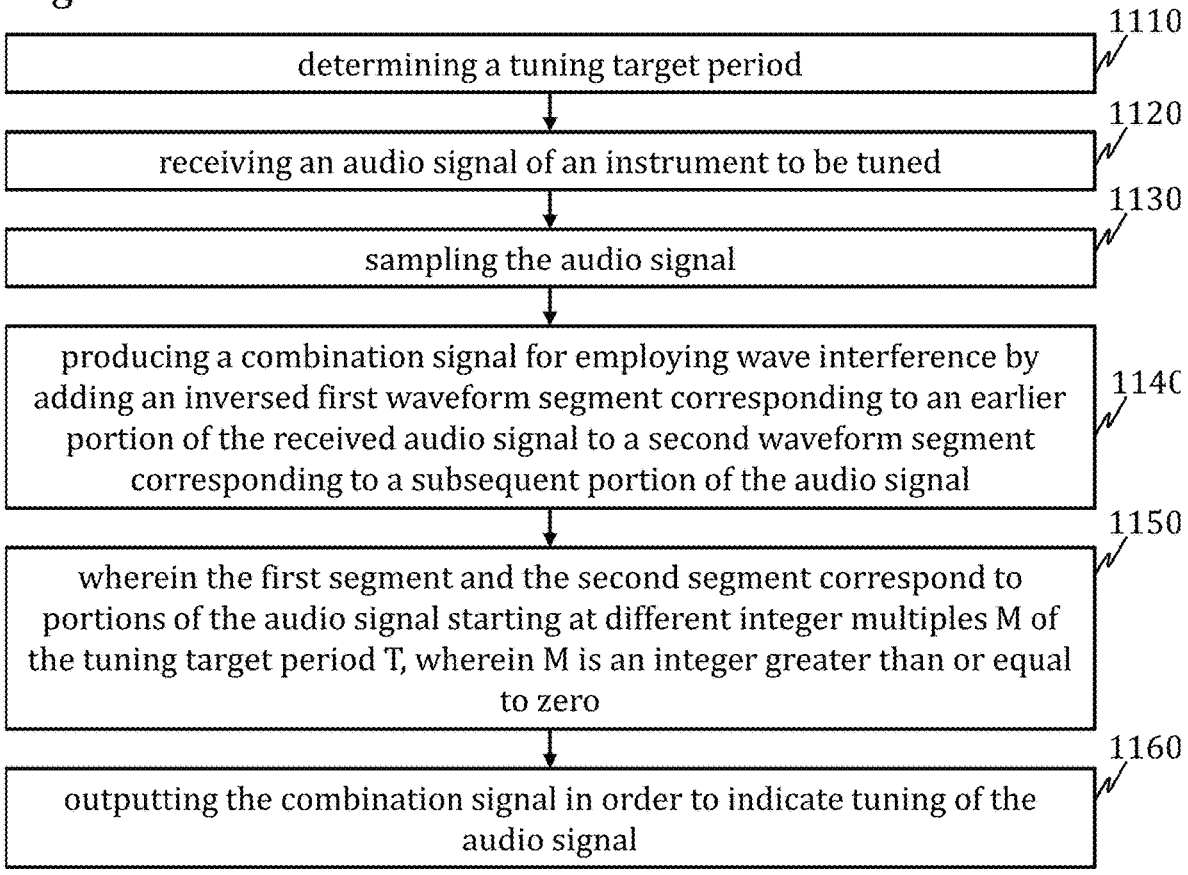
FIG. 11 shows a flow chart illustrating operation of a digital tuner of a third example aspect.

FIG. 11 shows a flow chart illustrating operation of a digital tuner of a third example aspect, comprising:

1110. determining a tuning target period;

1120. receiving an audio signal of an instrument to be tuned;

1130. sampling the audio signal; and

1140. producing a combination signal for employing wave interference by adding an inversed first waveform segment corresponding to an earlier portion of the received audio signal to a second waveform segment corresponding to a subsequent portion of the audio signal;

1150. wherein the first segment and the second segment are based on portions of the audio signal starting with at different integer multiples M of tuning target period T, wherein M is an integer greater than or equal to zero; and

1160. outputting the combination signal in order to indicate tuning of the audio signal.

Various embodiments have been presented. It should be appreciated that in this document, words comprise, include and contain are each used as open-ended expressions with no intended exclusivity.

The proposed aspects of the disclosed embodiments are based on an idea that bears some resemblance to the above-described analog rotating-disc strobe tuner. However there are also clear differences that set the aspects of the disclosed embodiments apart from prior art: 1) tuning is made using only the sound, without needing the rotating disc and 2) the sound itself is shown to the user in a way that provides the user sufficient information for accurate tuning. In other words, the pitch of the sound does not necessarily need to be measured at all, but the user is able to judge from the visualization directly whether the sound is too low or too high, and by how much.

The foregoing description has provided by way of non-limiting examples of particular implementations and embodiments a full and informative description of the best mode presently contemplated by the inventors for carrying out the aspects of the disclosed embodiments. It is however clear to a person skilled in the art that the present disclosure is not restricted to details of the embodiments presented in the foregoing, but that it can be implemented in other embodiments using equivalent means or in different combinations of embodiments without deviating from the characteristics of the present disclosure.

Furthermore, some of the features of the afore-disclosed embodiments of the present disclosure may be used to advantage without the corresponding use of other features. As such, the foregoing description shall be considered as merely illustrative of the principles of the present disclosure, and not in limitation thereof. Hence, the scope of the present disclosure is only restricted by the appended patent claims.

We claim:

1. A digital tuning method comprising:

determining a tuning target period;

receiving an audio signal from an instrument to be tuned;

obtaining a plurality of different segments of the audio signal starting at times that correspond to integer multiples of the target period;

producing waveform samples from the segments; and causing displaying of a succession of waveform segments at same display position using said segments so that the shape of the waveform appears to move on the display at a speed and direction directly dependent on a difference of a wave period of the audio signal to be tuned and the tuning target period.

2. A digital tuner comprising:

a tuning period selector configured to determine a tuning target period;

an input for receiving an audio signal from an instrument to be tuned;

at least one processor configured to cause:

obtaining a plurality of different segments of the audio signal starting at times that correspond to integer multiples of the target period;

producing waveform samples from the segments; and causing displaying of a succession of waveform segments at same display position using said segments so that the shape of the waveform appears to move on the display at a speed and direction directly dependent on a difference of a wave period of the audio signal to be tuned and the tuning target period.

3. The digital tuner of claim 2, wherein the displaying of the succession of waveform segments employs a representation other than the time-domain acoustic waveform of the sound.

4. The digital tuner of claim 3, wherein the representation has time resolution higher than a rate at which the target periods are received.

5. The digital tuner of claim 2, wherein the tuning period selector comprises a user interface configured to receive the tuning target pitch from a user.

6. The digital tuner of claim 2, wherein the tuning period selector comprises a tuning period selection circuitry configured to perform an automatic selection of the target pitch.

7. The digital tuner of claim 2, wherein the length of the displayed waveform segments is proportional to the target period.

8. The digital tuner of claim 2, wherein waveform samples are formed by combining groups of segments.

9. The digital tuner of claim 2, wherein the successive waveform segments are presented as diagrams representing intra-wave amplitude as a function of time.

10. The digital tuner of claim 2, wherein the magnitude of the successive waveform samples is automatically scaled based on dynamically measuring the level of the sound.

11. The digital tuner of claim 2, wherein the at least one processor is configured to adjust the tuning target period depending on a difference between the wave period of the audio signal to be tuned and the tuning target period.

12. The digital tuner of claim 2, wherein the at least one processor is further configured to determine movement speed of the displayed waveform segments by computing the movement distance between successive waveform segments divided by the time difference between the respective waveform segment start times.

13. The digital tuner of claim 11, wherein the at least one processor is further configured to set the tuning target period back to the original value of the tuning target period when the difference between the wave period of the audio signal to be tuned and the tuning target period meets a given closeness criterion.

14. The digital tuner of claim 11, wherein the at least one processor is further configured to provide a quantifying indication of the movement speed to a user.

* * * * *